US008657495B2

(12) United States Patent
Maxwell et al.

(10) Patent No.: US 8,657,495 B2
(45) Date of Patent: Feb. 25, 2014

(54) MULTILAYER DRAW TAPE

(75) Inventors: Jason R. Maxwell, Elgin, IL (US); Michael G. Borchardt, Naperville, IL (US)

(73) Assignee: The Glad Products Company, Oakland, CA (US)

( * ) Notice: Subject to any disclaimer, the term of this patent is extended or adjusted under 35 U.S.C. 154(b) by 413 days.

(21) Appl. No.: 12/854,415

(22) Filed: Aug. 11, 2010

(65) Prior Publication Data

US 2012/0039549 A1 Feb. 16, 2012

(51) Int. Cl.

| | |
|---|---|
| ***B65D 30/24*** | (2006.01) |
| ***B65D 33/16*** | (2006.01) |
| ***B65D 33/28*** | (2006.01) |
| ***B65D 39/00*** | (2006.01) |

(52) U.S. Cl.

USPC ..... 383/75; 383/53; 383/61.4; 383/72; 383/93

(58) Field of Classification Search

USPC ..... 383/75, 53, 61.4, 72, 93

See application file for complete search history.

(56) References Cited

U.S. PATENT DOCUMENTS

| | | | | |
|---|---|---|---|---|
| 2,798,523 | A * | 7/1957 | Barrett | 156/70 |
| 3,029,853 | A | 4/1962 | Piazze | |
| 3,506,048 | A * | 4/1970 | Annikki | 383/6 |
| 3,687,357 | A | 8/1972 | Hansen | |
| 4,310,578 | A * | 1/1982 | Katsura et al. | 383/108 |
| 4,813,794 | A * | 3/1989 | Herrington | 383/75 |
| 5,006,380 | A * | 4/1991 | Fraser | 428/35.2 |
| 6,602,174 | B1 | 8/2003 | Haverfield et al. | |
| 6,678,923 | B2 | 1/2004 | Goldberg et al. | |
| 7,914,207 | B1 * | 3/2011 | Beam | 383/11 |
| 2005/0019596 | A1 | 1/2005 | Marechal | |
| 2005/0031233 | A1 * | 2/2005 | Varanese et al. | 383/211 |
| 2005/0063622 | A1 * | 3/2005 | Kannabiran | 383/75 |
| 2006/0229581 | A1 | 10/2006 | Ulas et al. | |
| 2010/0172602 | A1 * | 7/2010 | O'Donnell et al. | 383/75 |
| 2010/0272379 | A1 * | 10/2010 | Hu et al. | 383/75 |
| 2010/0303388 | A1 * | 12/2010 | Kent et al. | 383/32 |
| 2011/0164834 | A1 * | 7/2011 | Stiglic et al. | 383/75 |

* cited by examiner

*Primary Examiner* — Jes F Pascua
*Assistant Examiner* — Derek Battisti
(74) *Attorney, Agent, or Firm* — Thomas C. Feix

(57) ABSTRACT

The bag includes a draw tape that may be used to cinch closed the opening of the bag. The draw tape is multilayer with a polypropylene core and propylene-ethylene copolymer or other suitable polymers in the outer layers.

17 Claims, 3 Drawing Sheets

MULTILAYER DRAW TAPE

BACKGROUND OF THE INVENTION

1. Field of the Invention

This invention relates generally to bags having a draw tape. More particularly, the present invention relates generally to trash bags having a draw tape.

2. Description of the Related Art

Among their many applications, it is known to use thermoplastic bags as liners in trash or refuse receptacles. Trash receptacles that employ such liners may be found at many locations, such as, from small household waste baskets and kitchen garbage cans. The trash canisters are typically made from a rigid material such as metal or plastic. Bags that are intended to be used as liners for such refuse containers are typically made from low-cost, pliable thermoplastic material. When the receptacle is full, the thermoplastic liner actually holding the trash can be removed for further disposal and replaced with a new liner. To avoid inadvertently spilling the contents during disposal, the bags may be provided with a draw tape that allows for constricting or closing the open circumference of the bag. The draw tape may also be tied into a knot to simplify handling of the bag during disposal.

Draw tape bags are formed by employing two pliable plastic sheets joined on three sides (or a U-folded plastic sheet joined on two sides) and open on the remaining side. A tubular hem is provided at the open edge of each sheet and contains a cord or pliable thermoplastic strip. One or more access holes are provided in the tubular hem to expose the cord or strip, so as to facilitate pulling the cord or strip through the opening. The action of pulling the cord or strip through the opening results in both closing the open mouth of the bag and formation of a handle whereby the bag may be carried by means of the cord or strip.

Draw tape bags have been commercially available for several years. For example, draw tape or draw cord bags are generally described in U.S. Pat. No. 2,798,523, 3,029,853, 3,506,048 and 3,687,357. A multilayer draw tape is described in U.S. Pat. No. 5,006,380 to Fraser. Fraser addresses the problem of providing a strong draw tape that is still heat sealable to the bag materials by providing a draw tape having a core layer of high density polyethylene with two outer layers of low density polyethylene and low density polyethylene with comonomers such as butene-1, pentene-1, hexene-1, heptene-1, octene-1 and mixtures thereof. The draw tape was produced as a multilayer blown film. Another approach is disclosed in U.S. Pat. App. 2005/0063622 to Kannabiran, where a polymeric blend of materials is used for both strength and sealability.

As is clear from the above discussion, continued technology improvement is needed to address the unique problems associated with the strength of the draw tape and its sealability to relatively thin pliable bag forming materials.

BRIEF SUMMARY OF THE INVENTION

In accordance with the principles of the present invention, in one embodiment, a draw tape bag comprising a first sidewall; a second sidewall, the second sidewall joined to the first sidewall by a closed bottom end, a first edge, and a second edge, thereby defining an open top end having a top surface with a top length; at least one of the sidewalls forming a hem having a top length and extending along the open top end disposed opposite the bottom end having a bottom length, the hem including one or more draw tape notches; a pliable thermoplastic draw tape housed within the hem and attached to the bag by side seals at the first and second edges of the bag; wherein the draw tape comprises a multilayer structure with a polypropylene core and propylene-ethylene copolymer outer layers.

In an embodiment, a draw tape bag comprising a first sidewall; a second sidewall, the second sidewall joined to the first sidewall by a closed bottom end, a first edge, and a second edge, thereby defining an open top end having a top surface with a top length; both of the sidewalls forming a hem having a top length and extending along the open top end disposed opposite the bottom end having a bottom length, the hem including one or more draw tape notches; a pliable thermoplastic draw tape housed within the hem and attached to the bag by side seals at the first and second edges of the bag; wherein the draw tape comprises a multilayer structure with a polypropylene core comprising greater than 80% polypropylene and outer layers comprising propylene-ethylene copolymer having 8% to 30% ethylene.

In one embodiment, the draw tape bag comprising a first sidewall; a second sidewall, the second sidewall joined to the first sidewall by a closed bottom end, a first edge, and a second edge, thereby defining an open top end having a top surface with a top length; both of the sidewalls forming a hem having a top length and extending along the open top end disposed opposite the bottom end having a bottom length, the hem including one or more draw tape notches; a pliable thermoplastic draw tape housed within the hem and attached to the bag by side seals at the first and second edges of the bag; wherein the draw tape comprises a multilayer structure with a polypropylene core and outer layers comprising propylene-ethylene copolymer; wherein the draw tape is produced by a slot cast extrusion process.

The thermoplastic bag may be produced in a high speed manufacturing process that develops continuous sheet-like webs of thermoplastic material into the finished bag via automated equipment. The process may form hems along an edge of the advancing web for accommodating the draw tape. The process may provide a strip of draw tape material in a relaxed or pre-stretched condition, insert the strip into the hem, and form the side seals in the relaxed or pre-stretched condition. These and other advantages and features of the thermoplastic bag will become apparent from the following description and accompanying drawings.

BRIEF DESCRIPTION OF THE DRAWINGS

The foregoing aspects and others will be readily appreciated by the skilled artisan from the following description of illustrative embodiments when read in conjunction with the accompanying drawings, in which.

DETAILED DESCRIPTION

Figure 1:
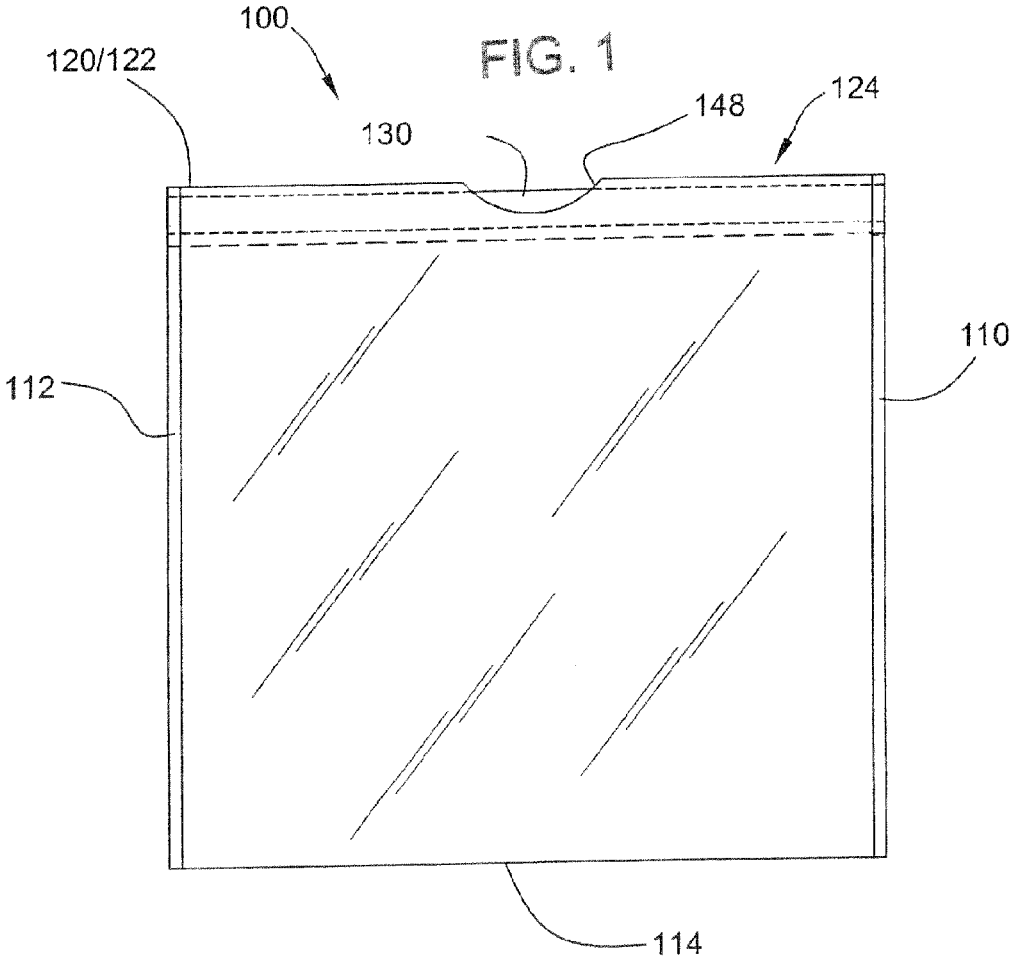
FIG. 1 is a perspective view of a thermoplastic bag having a draw tape.

Reference will now be made to the drawings wherein like numerals refer to like parts throughout. For ease of description, the components of this invention are described in the normal (upright) operating position, and terms such as upper, lower, horizontal, top, bottom, etc., are used with reference to this position. It will be understood, however, that the components embodying this invention may be manufactured, stored, transported, used, and sold in an orientation other than the position described.

Figures illustrating the components of this invention show some conventional mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

All publications, patents and patent applications cited herein, whether supra or infra, are hereby incorporated by reference in their entirety to the same extent as if each individual publication, patent or patent application was specifically and individually indicated to be incorporated by reference.

As used herein and in the claims, the term "comprising" is inclusive or open-ended and does not exclude additional unrecited elements, compositional components, or method steps. Accordingly, the term "comprising" encompasses the more restrictive terms "consisting essentially of" and "consisting of".

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein may be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

Figure 2:
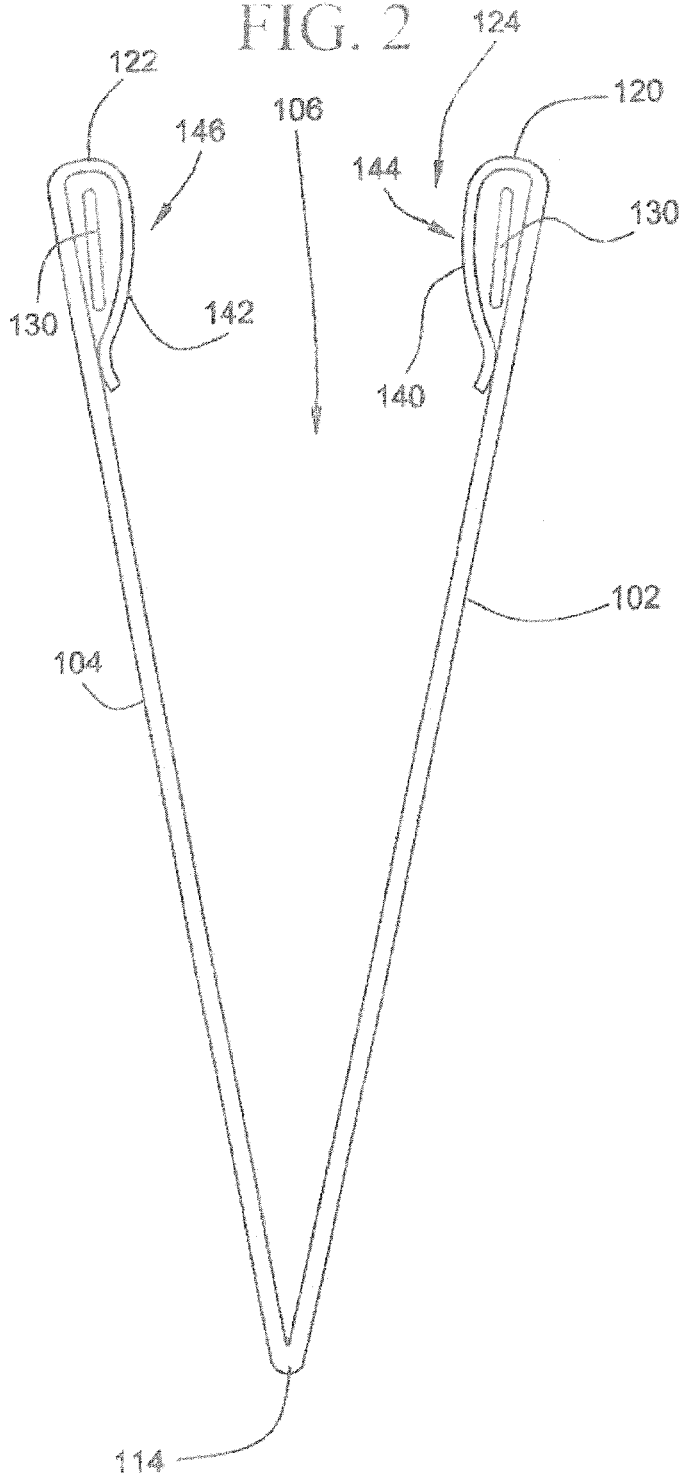
FIG. 2 is a cross-sectional view of the thermoplastic bag taken along line 3-3 of FIG. 1 and illustrating a draw tape accommodated in a hem.

Referring to FIGS. 1 and 2, there is illustrated a thermoplastic bag 100 of the kind useful as a liner for trash receptacles and refuse containers. Of course, the illustrated bag may have additional or different uses. The bag 100 may be made from a first sidewall 102 and opposing second sidewall 104 overlaid and joined to the first sidewall to define an interior volume 106 for holding trash. The first and second sidewalls may have matching rectangular or square shapes and may be joined along a first side edge 110, a second side edge 112 that may be parallel to and spaced apart from the first side edge, and a closed bottom edge 114 that extends between the first and second side edges. The sidewalls 102, 104 may be joined along their edges by any suitable joining process such as, for example, heat sealing in which the thermoplastic material bonds or melts together. Other sealing or joining processes may include ultrasonic methods and adhesive.

The first and second sidewalls 102, 104 may be made of flexible or pliable thermoplastic material formed or drawn into a smooth, thin-walled web or sheet. Examples of suitable thermoplastic materials may include polymers, for example, polyethylenes (such as, high density polyethylene, low density polyethylene, linear low density polyethylene, very low density polyethylene, ultra low density polyethylene, metallocene based linear low density polyethylene), polypropylene, ethylene vinyl acetate, nylon, polyester, ethylene vinyl alcohol, ethylene-methyl acrylate, or polystyrene, PLA and other degradable based materials, and may be formed in combinations and in single or multiple layers. When used as a garbage can liner, the thermoplastic material will typically be opaque but could also be transparent, translucent, or tinted. Furthermore, the material used for the sidewalls may provide a fluid barrier, such as, a liquid barrier and/or a gas barrier and may include other features such as being treated with deodorants and/or disinfectants as is sometimes desirable in the production of trash can liners.

To access the interior volume 106, the top edges 120, 122 of the first and second sidewalls between the first and second side edges and which are located opposite the bottom edge 114 may remain un-joined to provide the periphery of an opening 124. When the bag 100 is placed in a trash receptacle, the top edges 120, 122 corresponding to the opening 124 are typically folded back over the rim to help retain the bag in a vertical position within the receptacle.

To close the opening 124 of the bag 100 when, for example, disposing of the trash receptacle liner, the bag may be fitted with a draw tape 130. To accommodate the draw tape 130, the top edges 120, 122 of the first and second sidewalls 102, 104 corresponding to the periphery of the opening 124 may include respective first and second hem flaps 140, 142. The first hem flap 140 may be folded back into the interior volume 106 and attached to the interior surface of the first sidewall 102 to form a first hem 144. Similarly, the second hem flap 142 of the second sidewall 104 is similarly folded back into the interior volume 106 and attached to the second sidewall to form a second hem 146. The hem flaps may be attached to the interior surfaces of the sidewalls by adhesive, heat seals or otherwise. In other embodiments, the hems may be formed by folding the hem flaps toward the exterior of the sidewalls and attaching them to the sidewall exterior surface, or the hems may be formed as separate elements that are attached to the sidewalls. To access the draw tape 130, as illustrated in FIG. 1, a notch 148 may be disposed through either or both of the respective first and second top edges 120, 122, for example the notches may be centered along the hem between the first and second edges. Pulling the draw tape 130 through the notches 147, 148 constricts the top edges 120, 122 thereby drawing closed the opening 124.

Figure 3:
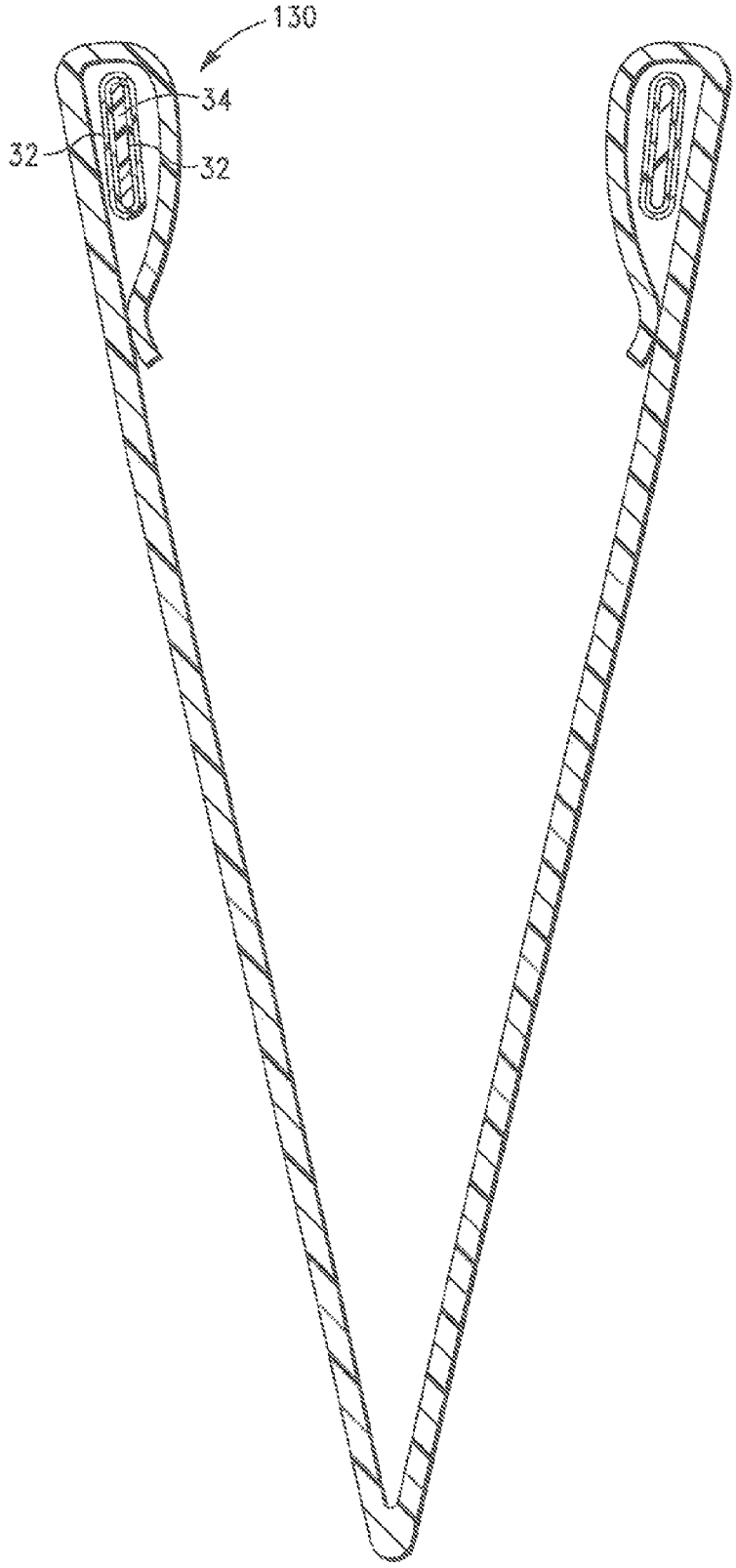
FIG. 3 is a cross-sectional view of a draw tape of the invention.

As shown in FIG. 3, the draw tape 130 may be formed as a multilayer structure, wherein the outer layers 32 are formed from propylene-ethylene copolymer. Suitable propylene-ethylene copolymers include the Versify™ plastomers from Dow, having a density of 0.858 to 0.888 g/cc and Exxon Vistamaxx™ plastomers from Exxon, having 8-16% ethylene content and having a density of 0.862 to 0.879 g/cc. In other embodiments, the outer layers 32 are formed from mixtures of polyethylene and propylene-ethylene copolymer. In other embodiments, the outer layers 32 can comprise polymers selected from the group consisting of polyethylene, ethylene-propylene copolymers, ethylene-alpha olefin copolymers, and mixtures thereof.

The polypropylene core suitably comprises greater than 80%, or greater than 90%, or greater than 98% polypropylene, or 100% polypropylene. The core layer 34 can comprise polymers selected from the group consisting of polypropylene, polyethylene, ethylene-propylene copolymers, ethylene-alpha olefin copolymers having from 4 to 12 carbon atoms, propylene-alpha olefin copolymers having from 4 to 12 carbon atoms, propylene-elastomer polymers (such as those described in WO2003/040201, which is hereby incorporated by reference in its entirety), ethylene-elastomer polymers, and mixtures thereof. Suitable alpha olefins for use as the comonomer in such materials include 1-octene, 1-hexene and 1-butene. Other suitable elastomers for the core layer comprise polymer blocks of homopolymers or copolymers of aliphatic conjugated dienes, such as polyisoprene, polybutadiene, and styrene butadiene elastomers.

The core layer may also comprise fillers. Suitable fillers are discussed in a description of nanocomposite thermoplastic olefins WO2001/48080, which is hereby incorporated by reference in its entirety. Thermoplastic olefin usually is a blend of a thermoplastic, usually polypropylene, and a thermoplastic elastomer. A nanocomposite TPO is formed when the thermoplastic of the TPO contains the nano-filler. Suitable nano-fillers are silicates and other fillers such as Magadiite, Kenyalte, smectites, hormites, vermiculites, illites, micas, and chlorites, Biophilite, kaolinite, dickalite, talcs, Semectites, Vermiculites, Micas, Brittle micas, Octosilicates, Kanemites, Makatites, and Zeolitic layered materials.

The draw tape has a thickness of about 1 to 4 mils, or about 2 to 3 mils. The ratio thickness of the outer layer to the inner layer is about 1 to 20 to about 2 to 1, or about 1 to 10 to about 1 to 1. Additives that can be layers include antiblocking agents, slipping agents, fragrances, processing additives generally, anti-bacterial agents, anti-microbial agents, printing inks, recycled resins, coloring agents, anti-static agents, fillers or the like.

Draw tapes containing a polyethylene core are typically make by blown film extrusion where the polymer is extruded in an upward vertical direction in the form of a tube although it can be extruded downward or even sideways. After extrusion of the molten polymer through the annular die, the tubular film is expanded to the desired extent, cooled, or allowed to cool and flattened. The tubular film is flattened by passing the film through a collapsing frame and a set of nip rolls. These nip rolls are driven, thereby providing means for withdrawing the tubular film away from the annular die. The films of this invention may also be produced by the blown film extrusion method.

The multilayer films of this invention are suitably produced by what is commonly known as the slot cast extrusion method. The slot cast method produces a film of better clarity than the other methods known to the art. The multilayer film may be slot cast on extrusion equipment using a slot cast multiple-orifice die or a multilayer adapter for a single layer slot cast die.

Exemplary embodiments are described herein. Variations of those embodiments may become apparent to those of ordinary skill in the art upon reading the foregoing description. The inventor(s) expect skilled artisans to employ such variations as appropriate, and the inventor(s) intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A draw tape bag comprising:

a first sidewall;

a second sidewall, the second sidewall joined to the first sidewall by a closed bottom end, a first edge, and a second edge, thereby defining an open top end having a top surface with a top length;

at least one of the sidewalls forming a hem having a top length and extending along the open top end disposed opposite the bottom end having a bottom length, the hem including one or more draw tape notches;

a pliable thermoplastic draw tape housed within the hem and attached to the bag by side seals at the first and second edges of the bag;

wherein the draw tape comprises a multilayer structure with a polypropylene core and outer layers of a copolymer consisting essentially of propylene and ethylene, and wherein the outer layer comprises a mixture of the copolymer and polyethylene.

2. The draw tape bag of claim 1, wherein the propylene-ethylene copolymer contains 8% to 30% ethylene.

3. The draw tape bag of claim 1, wherein the draw tape has a thickness of from 1 to 4 mils.

4. The draw tape bag of claim 1, wherein the draw tape has a thickness of from 2 to 3 mils.

5. The draw tape bag of claim 1, wherein the ratio thickness of the outer layer to the inner layer is 1 to 20 to 2 to 1.

6. The draw tape bag of claim 1, wherein the ratio thickness of the outer layer to the inner layer is 1 to 10 to 1 to 1.

7. The draw tape bag of claim 1, wherein the draw tape is produced by a slot cast extrusion process.

8. The draw tape bag of claim 1, wherein the draw tape is produced by a blown film extrusion process.

9. A draw tape bag comprising:

a first sidewall;

a second sidewall, the second sidewall joined to the first sidewall by a closed bottom end, a first edge, and a second edge, thereby defining an open top end having a top surface with a top length;

both of the sidewalls forming a hem having a top length and extending along the open top end disposed opposite the bottom end having a bottom length, the hem including one or more draw tape notches;

a pliable thermoplastic draw tape housed within the hem and attached to the bag by side seals at the first and second edges of the bag;

wherein the draw tape comprises a multilayer structure with a polypropylene core comprising greater than 80% polypropylene and outer layers comprising a copolymer consisting essentially of propylene and ethylene and having 8% to 30% ethylene, and wherein the outer layer comprises a mixture of the copolymer and polyethylene.

10. The draw tape bag of claim 9, wherein the draw tape has a thickness of from 1 to 4 mils.

11. The draw tape bag of claim 9, wherein the draw tape has a thickness of from 2 to 3 mils.

12. The draw tape bag of claim 9, wherein the ratio thickness of the outer layer to the inner layer is 1 to 20 to 2 to 1.

13. The draw tape bag of claim 9, wherein the ratio thickness of the outer layer to the inner layer is 1 to 10 to 1 to 1.

14. The draw tape bag of claim 9, wherein the draw tape is produced by a slot cast extrusion process.

15. The draw tape bag of claim 9, wherein the draw tape is produced by a blown film extrusion process.

16. The draw tape bag of claim 9, wherein the draw tape polypropylene core comprises greater than 90% polypropylene.

17. The draw tape bag of claim 9, wherein the draw tape polypropylene core comprises greater than 98% polypropylene.

* * * * *